United States Patent [19]

Peachee et al.

[11] Patent Number: 4,670,631

[45] Date of Patent: Jun. 2, 1987

[54] MODIFIED SWITCH ASSEMBLY FOR ELECTRICAL MACHINERY

[75] Inventors: C. Theodore Peachee; William D. Crow, both of St. Louis, Mo.

[73] Assignee: Emerson Electric Co., St. Louis, Mo.

[21] Appl. No.: 831,417

[22] Filed: Feb. 20, 1986

[51] Int. Cl.[4] ..... H01H 35/10

[52] U.S. Cl. ..... 200/80 R; 310/68 E

[58] Field of Search ..... 200/80 R, 239, 240, 200/241, 245, 246, 283, 290; 310/68 E; 318/462, 793; 307/120; 73/535, 538, 548, 550

[56] References Cited

U.S. PATENT DOCUMENTS 4,034,173 7/1977 Crow ..... 200/80 R

*Primary Examiner*—G. P. Tolin

*Attorney, Agent, or Firm*—Polster, Polster and Lucchesi

[57] ABSTRACT

A switch assembly integrally formed with a terminal connection board for selectively engaging and disengaging contacts connected to electrical machinery such as the windings for a dynamoelectric machine, the switch assembly including opposed contacts shaped and movable relative each other to provide rolling wipe-action contact wear, one of the contacts being mounted on a flat conductive member having an arm portion extending laterally to one side thereof which is engaged by and is actuable by a switch arm mounted on the terminal board.

8 Claims, 9 Drawing Figures

MODIFIED SWITCH ASSEMBLY FOR ELECTRICAL MACHINERY

BACKGROUND OF THE INVENTION

This invention relates to switch assembly structure for dynamoelectric machinery and more particularly to an improved structure for a switch assembly which can be utilized in any one of several forms in conjunction with centrifugal actuators for selectively energizing windings of dynamoelectric machines.

U.S. Pat. No. 4,034,173, issued to William D. Crow on July 5, 1977 discloses and describes a number of dynamoelectric machines, such as split phase induction motors and capacitor start motors, which utilize at least two windings for "start" and "run" operating conditions. These motors include stator and rotor assemblies, the rotor assembly including a shaft and the stator assembly including a plurality of windings. As is known in the art, selective energization of windings is used to generate suitable forces for rotating the rotor assembly in both "start" and "run" conditions. For example, a rotating field may be established in a single-phase motor through an auxiliary or starting winding having current out of phase with the current in the main winding. The starting winding has a higher resistance than the main or running winding and, to eliminate losses due to the extra resistance, the starting winding is disconnected through a centrifugal actuator after the rotor has attained a desired speed, so as to continue operation by single-phase action alone.

It has been recognized as desirable that switch assemblies utilized for such purposes be low in overall construction, assembly and maintenance costs, provide appropriate contact pressure independent of switch arm position, provide for lost motion adjustment, be readily mountable, minimize contact wear and breakage and reduce construction, maintenance, operation and replacement costs. The modified switch assembly of the present invention recognizes and accomplishes these desired features, providing a switch assembly structure which requires a minimum of contact pressure, avoids undesirable variations in contact force by utilization of flat, flexible conductive members and provides a maximum of rolling wipe-action contact to reduce contact wear and breakage. In addition, the switch assembly of the present invention effectively utilizes switch arm action to ensure positive and continued electrical contact maintenance, readily accommodating for conventional machinery impact and vibration.

Various other features of the present invention will become obvious to one skilled in the art upon reading the disclosure set forth herein.

SUMMARY OF THE INVENTION

More particularly, the present invention provides a switch assembly including a terminal board for connecting a power source to the switch assembly comprising: a first electrical contact means mounted on the board; a conductive means mounted to the board including a base portion and a flexible conductive member extending outwardly from the base portion in cantilevered fashion, the conductive member including a second electrical contact means positioned in spaced opposed relation to the first electrical contact means and further including an arm portion extending laterally to one side thereof; a switch arm mounted for movement between at least a first position and a second position with respect to the terminal board to engage the laterally extending arm portion of the cantilevered conductive member to urge the second contact means to contact the first contact means; and, means cooperative with the first and second contact means when urged into contact to provide yielding and resilient engagement therebetween and ensuring electrical contact maintenance through a rolling wipe-action contact.

It is to be understood that various changes can be made by one skilled in the art in the shape, construction and operation of the several parts of the structure disclosed herein without departing from the scope or spirit of the present invention. For example, although the switch assembly as disclosed is particularly utilizable with a split phase dynamoelectric machine with both main and auxiliary windings initially engaged, the switch assembly can be so modified as to include more than one cantilevered main body portion and more than one set of engaging contacts for other types of dynamoelectric machinery.

BRIEF DESCRIPTION OF THE DRAWINGS

Referring to the drawings which disclose one advantageous embodiment of the present invention.

DESCRIPTION OF THE PREFERRED EMBODIMENT

Figure 1:
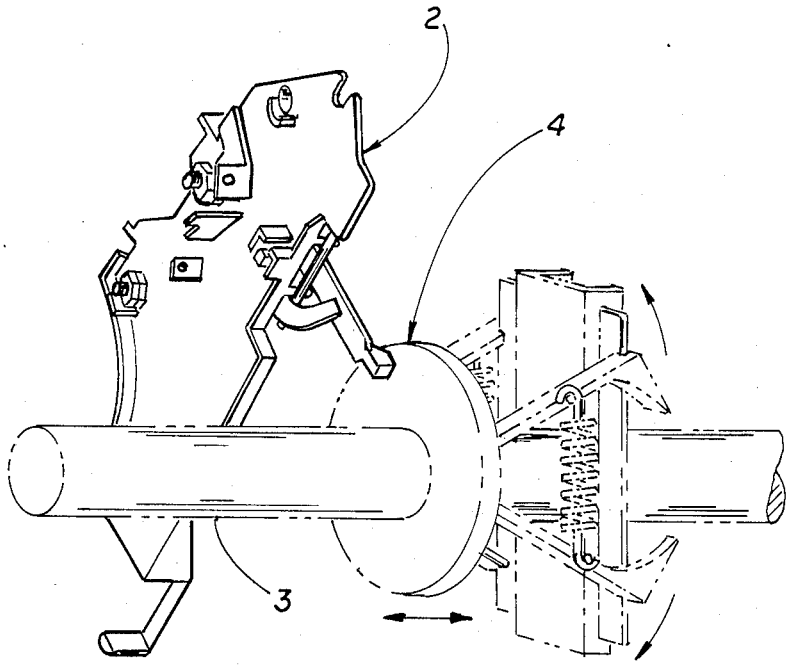
FIG. 1 is a perspective view, illustrating the inventive switch assembly positioned on the shaft of a conventional split phase type dynamoelectric machine (not shown) with a conventional centrifugal actuator mounted on the shaft in engagement with the switch arm of the switch assembly.
Figure 2:
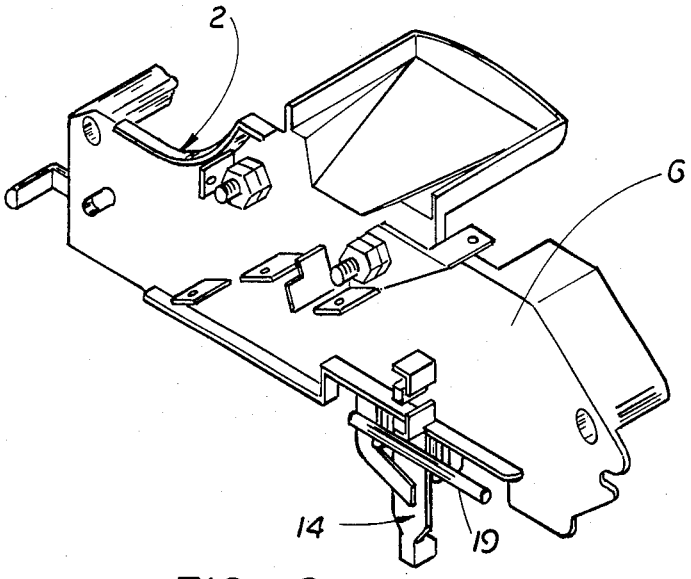
FIG. 2 is an enlarged view in perspective of a terminal board utilized in conjunction with the inventive switch assembly.

Referring to FIG. 1 of the drawings, the inventive switch assembly broadly indicated by reference numeral 2 is shown in its application with electric motor shaft 3 connected to a rotor driven by stator windings of a dynamoelectric machine (not shown) which can be of a split phase type to include both main and auxiliary windings for starting purposes, as is known in the art. A centrifugal actuator 4 which can be any one of several known types is shown as mounted on shaft 3 to engage the switch arm described hereinafter during starting operations of a dynamoelectric machine.

Referring to FIGS. 2–5 of the drawings, a terminal board 6 is disclosed in different views, this terminal board being sized and adapted to be mounted within a chamber of a dynamoelectric motor, details of such mounting not being described herein.

The electrical circuitry including the quick connect terminals are also not described in detail herein, it being sufficient to note that the terminal board connections as shown can be utilized to connect to the main and auxiliary windings of a typical split phase motor with the inventive switch assembly as shown being connected across the main power line along with the auxiliary or higher resistance starting windings, the switch contacts of the switch assembly being held in closed position by centrifugal actuator 4 during motor start-up operations to energize the starting windings until sufficient speed is attained by the motor rotor.

Figure 4:
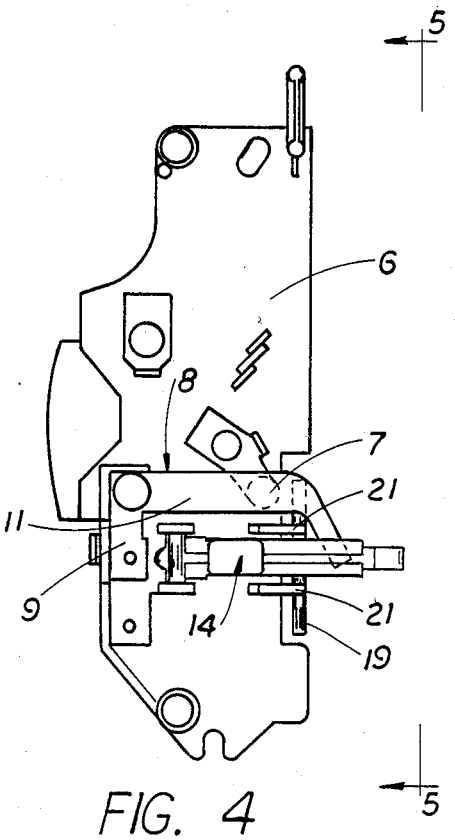
FIG. 4 is a plan view of the opposite side of the terminal board of FIG. 2.
Figure 5:
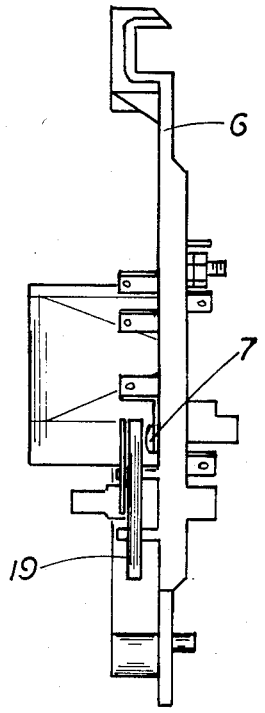
FIG. 5 is an end view of the terminal board of FIG. 4 taken in a plane through and in the direction of the arrows of line 5—5 of FIG. 4.
Figure 3:
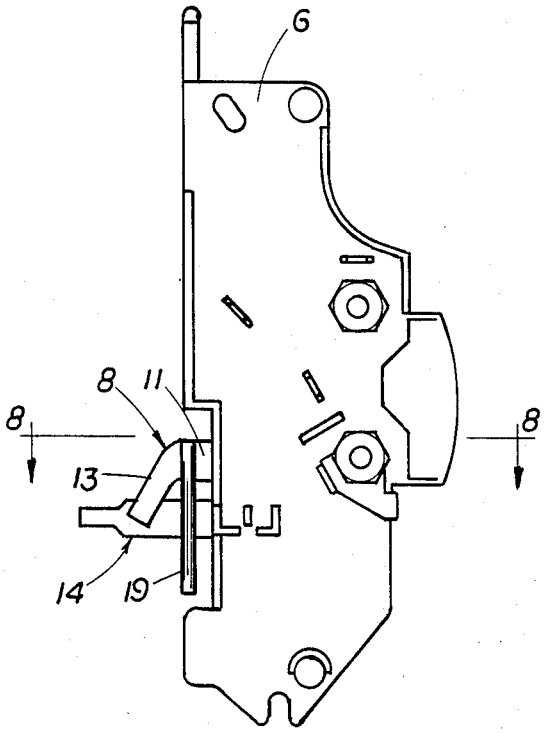
FIG. 3 is a plan view of the side of the terminal board shown in perspective in FIG. 2.
Figure 6:
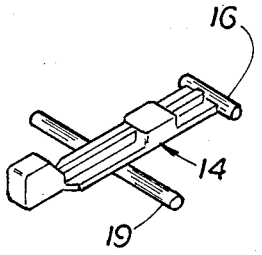
FIG. 6 is a perspective view of the switch arm of the inventive switch assembly shown in FIGS. 1–5.
Figure 7:
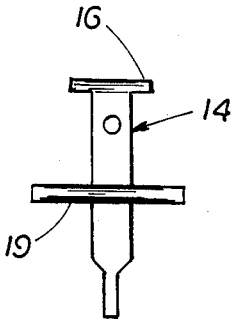
FIG. 7 is a plan view of the opposite side of the switch arm of FIG. 6.

As can be seen in FIGS. 4 and 5 of the drawings, terminal board 6 is provided with a fixed electrical contact 7. An electrically conductive strip 8, which can be formed from a flat, flexible conductive material such as copper, is mounted to terminal board 6.

Figure 9:
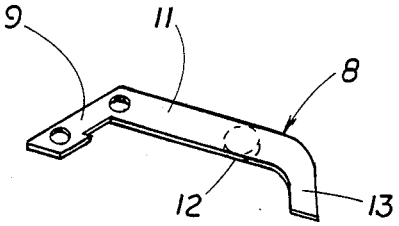

As can be seen in FIGS. 4 and 9, strip 8 is of generally flat, flexible L-shape configuration to include a base portion 9 fastened to terminal board 6 and a flexible main body portion 11 extending freely from base portion 9 in outwardly flexed cantilever fashion from the face of terminal board 6. Main body portion 11 of conductive strip 8 has fixedly mounted thereto an electrical contact 12 so positioned as to be normally in spaced opposed relation to fixed contact 7.

Figure 8:
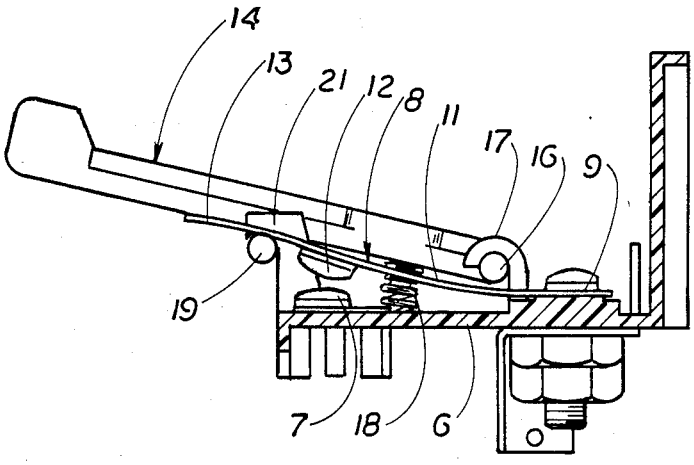
FIG. 8 is an enlarged cross-sectional view of the switch assembly of FIGS. 1–7 taken in a plane through and in the direction of the arrows of line 8—8 of FIG. 3; and, FIG. 9 is an enlarged perspective view of one side of the conductive member of the inventive switch assembly.

Referring to FIG. 8, it can be seen that opposed electrical contacts 7 and 12 are so contoured as to present opposed, mirror-image curvilinear convex surfaces to each other to enhance the rolling wipe-action described hereinafter (see FIG. 8).

Referring to FIGS. 1, 2, 3, 4 and 9, it can be seen that generally L-shape flexible conductive strip 8 further includes a laterally extending arm portion 13 extending from main body portion 11 in dog leg fashion advantageously at a preselected angle of approximately 30°. As can be seen in all of these aforementioned Figures, except FIG. 9, the free extremity of dog leg arm portion 13 in turn abuts or is engaged by switch arm 14. Switch arm 14 is pivotally mounted at one end to a pair of spaced L-shaped hook-like projections 17 extending from the face of terminal board 6 (FIG. 8).

As can also be readily seen in FIG. 8, a coiled biasing spring 18 is mounted between terminal board 6 and intermediate the extremities of switch arm 14 to bias the switch arm 14 and thus the outwardly and laterally extending flexed arm portion 13 of conductive strip 8 in a direction away from terminal board 6. In this regard, switch arm 14 is provided with an integral cross bar 19 which is positioned to engage against the main portion 11 of conductive strip 8 when the switch arm 14 is biased away from the face of terminal board 6 by coil spring 18. To limit the action of biasing spring 18 against switch arm 14 and the conductive strip 8, the ends of cross bar 19 of switch arm 14 are engaged by a pair of spaced, L-shaped hook like members 21, which also, like L-shaped projections 17, extend from the face of terminal board 6.

In starting operation, as abovementioned, centrifugal actuator 4 is so positioned on shaft 3 as to maintain switch arm 14 and electrical contacts 7 and 12 on terminal board 6 in closed electrical engagement. The switch assembly 2 can be electrically connected along with the high resistance auxiliary or starting windings of a split phase motor across the main power lines and accordingly, with opposed contacts 7 and 12 in closed electrical engagement, current from the main power line passes through not only the main windings also connected to the main power line, but through the starting windings as well. When the motor attains the desired speed, the centrifugal actuator 4 on shaft 3 moves away from switch arm 14 and opposed contacts 7 and 12 are urged out of engagement through the action of coiled biasing spring 18.

In accordance with the present invention, during starting operations, the mirror-image contacts 7 and 12 which are held in engagement through the dog leg arm portion 13 of flat, flexible conductive strip 8 serve to provide a maximum of rolling wipe-action contact so as to reduce contact wear and breakage, the inventive switch assembly requiring a minimum of contact pressure and concomitantly avoiding undesirable variations in contact force regardless of conventional motor impact and vibrations.

The invention claimed is:

1. A switch assembly including a terminal board for connecting a power source to said switch assembly, comprising:

a first electrical contact/means mounted to said board;

a conductive means mounted to said board including a base portion and a flexible conductive member extending outwardly from said base portion in cantilevered fashion, said conductive member including a second electrical contact means positioned in spaced opposed relation to said first electrical contact means and further including an arm portion extending laterally to one side thereof;

a switch arm mounted for movement between at least a first position and a second position with respect to said terminal board and engaging said laterally extending arm portion of said cantilevered conductive member to urge said second contact means to contact said first contact means; and, means cooperative with said first and second contact means when they are urged into contact to provide yielding and resilient engagement therebetween to ensure electrical contact maintenance through a rolling wipe-action contact, at least one of said first and second contact means including a curvilinear surface, with said arm portion of sid cantilevered conductive member extending beyond and laterally offset to the body of said cantilevered conductive member to provide a dog leg having its free end engaged by said switch arm at a location laterally offset from said second electrical contact means included thereon whereby when said switch arm is actuated from sid first position to said second postion a rolling wipe-action contacting engagement occurs between said first and said second electrical contact means.

2. The switch assembly of claim 1, said first and second electrical contact means being so shaped and movable relative to each other to provide a rolling wipe-action contact to minimize contact wear.

3. The switch assembly of claim 1, said switch arm engaging said laterally extending arm portion of said cantilevered conductive member at a location laterally offset from said second electrical contact means included thereon.

4. The switch assembly of claim 1, said conductive member including said laterally extending arm portion being of a flat flexible material.

5. The switch assembly of claim 1, said conductive member including said laterally extending arm portion being formed from one piece of flat flexible conductive material with said arm portion extending at an approximately 30 degree angle from the cantilevered main body of said conductive member in dog leg fashion toward and in flexed abutment with said switch arm.

6. The switch assembly of claim 1, including a biasing spring means mounted between said terminal board and said switch arm to bias said switch arm away from said terminal board;

and stop means to limit said biasing spring action.

7. The switch assembly of claim 1, including a coiled biasing spring mounted between said terminal board and said switch arm to bias said switch arm in a direction away from said terminal board, said switch arm having a cross bar against which said conductive member abuts when said switch arm is biased away from said terminal board; and, hook members integral with and extending normal from said terminal board to engage said cross bar of said switch arm to limit said biasing spring action.

8. In an electric motor having a stator assembly and a rotor assembly, said rotor assembly including a shaft, said stator assembly including a plurality of windings, the selective energization of said windings being utilized to generate a force for rotating said rotor assembly, and a centrifugal actuator mounted to said shaft including at least a part movable relative to said shaft, the improvement which comprises:

a terminal board for electrically interconnecting said windings to a source of power;

a switch assembly attached to said board, said switch assembly adapted to interconnect respective ones of said windings to a source of power, said switch assembly including a first electrical contact mounted to said board;

a conductive strip formed from a flat, flexible conductive material mounted to said board including a base portion and a flexible main body portion extending outwardly therefrom in free cantilever fashion, said conductive strip including a second electrical contact positioned on said main body portion in opposed relation to said first electrical contact and further including a laterally extending arm portion extending in a dog leg at an approximately 30 degree angle from the main body portion;

said first and second contact means having opposed mirror-image curvilinear convex surfaces;

a switch arm mounted for movement between at least a first position and a second position with respect to said terminal board and engaging the free extremity of said laterally extending dog leg arm portion of said cantilevered conductive strip whereby a rolling wipe-action contacting engagement occurs between said first and said second electrical contacts;

a coiled biasing spring mounted between said terminal board and said switch arm to bias said switch arm in a direction away from said terminal board, said switch arm having a cross bar against which said main body portion of said conductive strip abuts when said switch arm is biased away from said terminal board; and, hook members integral with and extending normal from said terminal board to engage said cross bar of said switch arm to limit said biasing spring action.

* * * * *